US006145415A

United States Patent [19]

Liu

[11] Patent Number: 6,145,415

[45] Date of Patent: Nov. 14, 2000

[54] ADJUSTABLE PLIERS

[76] Inventor: Kuo-Chen Liu, No. 20 Da Chen Street., Ta Li Hsiang, Taichung Hsien, Taiwan

[21] Appl. No.: 09/248,895

[22] Filed: Feb. 12, 1999

[51] Int. Cl.[7] ..... B25B 13/22

[52] U.S. Cl. ..... 81/143; 81/126

[58] Field of Search ..... 81/126, 143, 145, 81/142

[56] References Cited

U.S. PATENT DOCUMENTS

| | | | |
|---|---|---|---|
| 3,232,150 | 2/1966 | Allegraud | 81/143 |
| 3,257,878 | 6/1966 | Andersen | 81/143 X |
| 5,568,752 | 10/1996 | Alford | 81/126 |

*Primary Examiner*—James G. Smith
*Attorney, Agent, or Firm*—Rosenberg, Klein & Lee

[57] ABSTRACT

A pair of pliers includes a head and a handle pivotally connected to the head which includes three parts. A movable jaw is movably received between the first part and the third part of the head and a first spring is connected between the movable jaw and the second part. The movable jaw has a toothed portion defined in one of two sides thereof. A pawl member is movably received between the first part and the second part with a second spring connected to the pawl member and the second part. The pawl member is moved along an inclined surface of the second part and has a toothed side which is disengagably matched with the toothed portion of the movable jaw by rotating the handle.

5 Claims, 5 Drawing Sheets

ADJUSTABLE PLIERS

FIELD OF THE INVENTION

The present invention relates to a pair of pliers, and more particularly, to a pair of pliers having a movable jaw which is pulled by a spring toward the fixed jaw, a pawl member disengagably connected to the movably movable jaw. The movable jaw is engaged with the pawl member when tightening an object and disengaged from the pawl member when rotating the pliers in the opposite direction.

BACKGROUND OF THE INVENTION

A conventional pair of pliers generally have a fixed jaw and a movable jaw which is moved by rotating an adjusting screw in the head of the pliers. The adjusting screw is threadedly engaged with a rack integrally connected to the movable jaw so that the movable jaw can be moved toward the fixed jaw or can be moved away from the fixed jaw by rotating the adjusting screw. Nevertheless, the pliers cannot reciprocatingly operated with the object clamped between the movable jaw and the fixed jaw without removing the pliers from the object because the object will be co-rotated with the pliers. Therefore, the operator has to remove the pliers from the object when the pliers is rotated to an extreme position and remove the pliers to clamp the object again. This is time-consuming and the operator feels frustration. Furthermore, it is difficult to rotate the adjusting screw because lubricant or oil is usually attached to the operator's hand.

The pliers in accordance with the present invention have a movable jaw which is removed from the fixed jaw whenever the handle of the pliers is rotated counter clockwise so that the pliers can tighten or loosen an object without removing the pliers from the object. The pliers of the present invention provide a convenient function for the operator to repeatedly rotate the handle thereof while the object is clamped between the fixed jaw and the movable jaw.

SUMMARY OF THE INVENTION

In accordance with one aspect of the present invention, there is provided a pair of pliers comprising a head having a second part fixedly connected between a first part and a third part, each of the first part and the third part having a slot defined therethrough and a first fixed jaw member extending laterally therefrom. The second part has a second fixed jaw member sandwiched between the two first fixed jaw members. A recess is defined in the second fixed jaw member and a plate extends inclinedly from the second fixed jaw member. The plate has a guide surface defined in one of two sides thereof and a shoulder portion is connected between the plate and the recess. A handle has an action end pivotally connected between the first part and the third part.

A movable jaw is movably received between the first part and the third part. A first spring has one end thereof connected to the movable jaw and the other end of the first spring is securely received in the recess of the second part. The movable jaw has two protrusions extending laterally from two opposite faces thereof and are respectively and movably received in the two slots of the first part and the third part. A toothed portion is defined in an end of the movable jaw.

A pawl member is movably installed between the movable jaw and the plate of the second part. The pawl member has the first end thereof contacting the action end of the handle between the first part and the third part. A second spring is connected between the second end of the pawl member and the shoulder portion of the second part. The pawl member has a first side slidable on the guide surface of the plate and a second side having a toothed surface which is disengagably engaged with the toothed portion of the movable jaw.

It is an object of the present invention to provide a pair of pliers which clamp an object by two jaws thereof when rotating the handle in the tightening direction, and releases the object when rotating the handle in the loosening direction.

Further objects, advantages, and features of the present invention will become apparent from the following detailed description with appropriate reference to the accompanying drawings.

DETAILED DESCRIPTION OF THE PREFERRED EMBODIMENT

Figure 1:
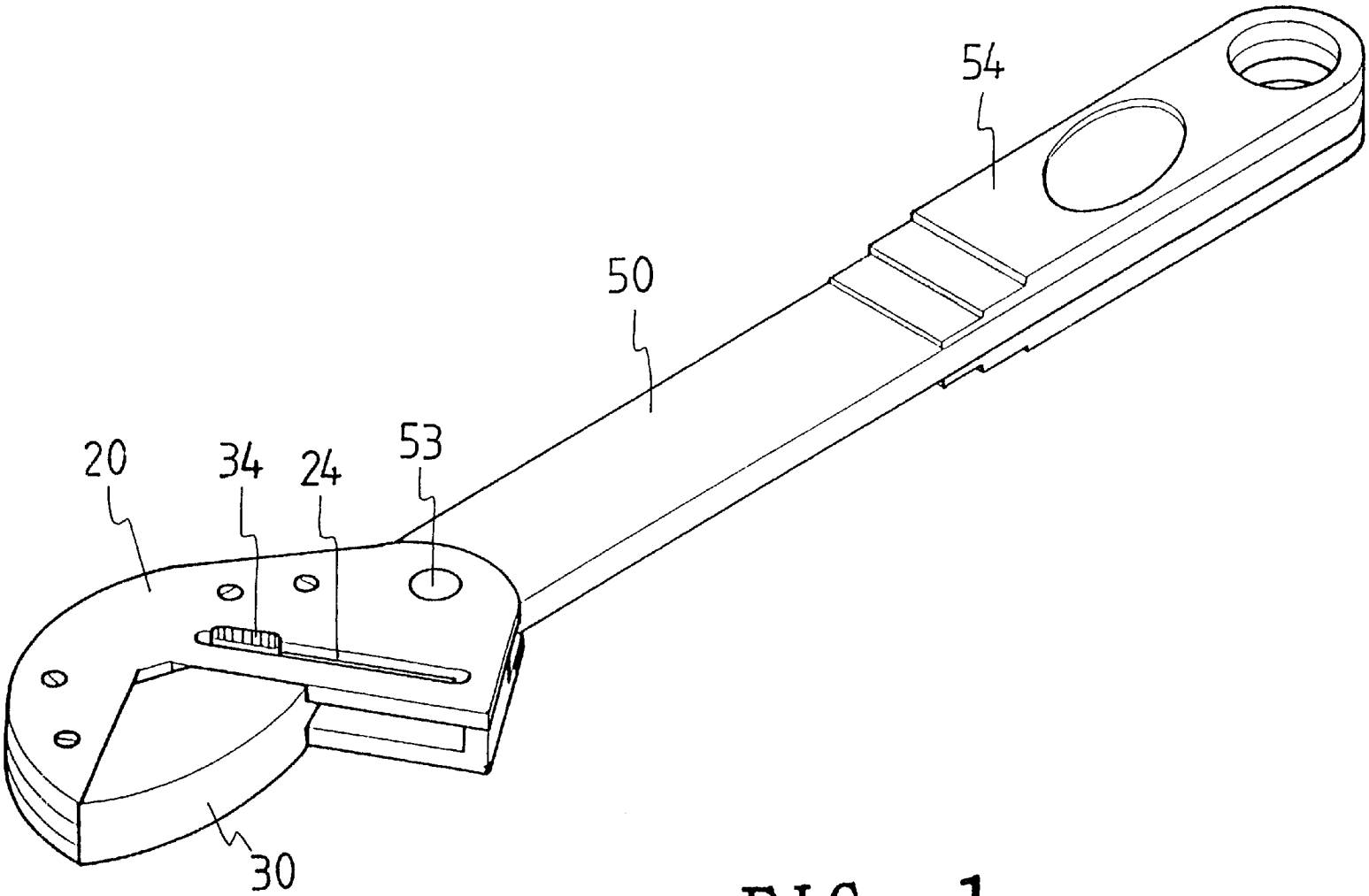
FIG. 1 is a perspective view of the pliers in accordance with the present invention.
Figure 2:
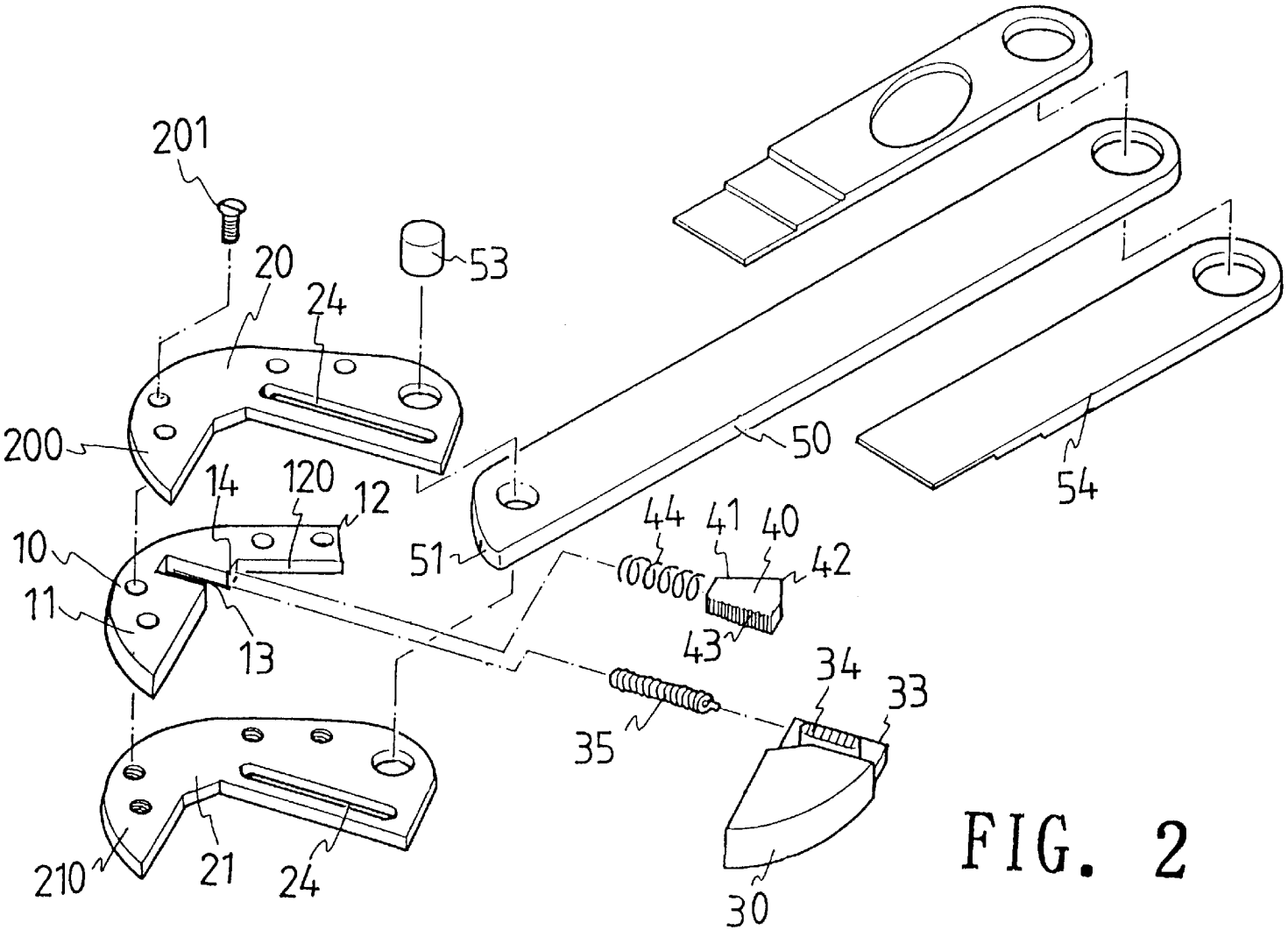
FIG. 2 is an exploded view of the pliers in accordance with the present invention.
Figure 3:
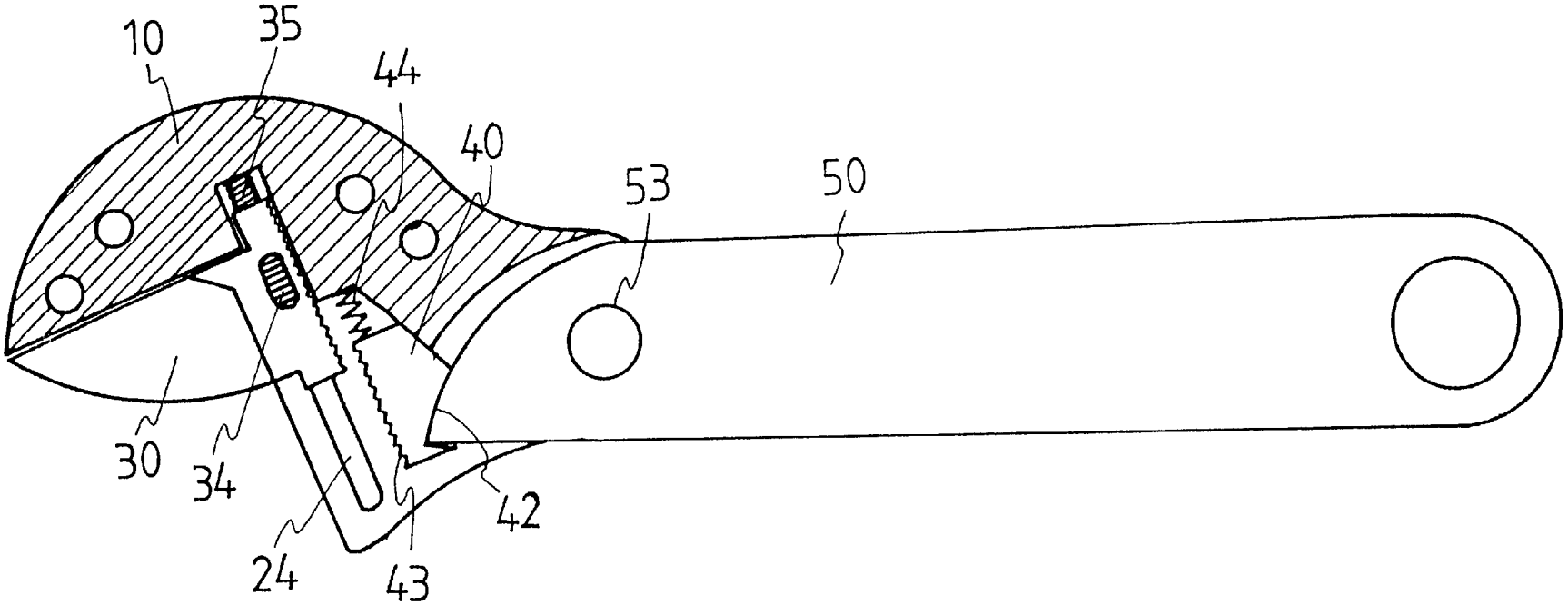
FIG. 3 is a side elevational view, partly in section, of the pliers when no object is clamped between the two jaws thereof.

Referring to FIGS. 1 to 3, the pair of pliers comprise a head composed of a first part 20, a second part 10 and a third part 21, wherein the second part 10 is fixedly connected between the first part 20 and the third part 21 by bolts 201 (only one is shown). Each of the first part 20 and the third part 21 has a slot 24 defined therethrough and a first fixed jaw member 200/210 extends laterally therefrom. The second part 10 has a second fixed jaw member 11 sandwiched between the two first fixed jaw members 200, 210, and a recess 13 is defined in the second fixed jaw member 11 and a plate 12 extends inclinedly from the second fixed jaw member 10. The plate 12 has a guide surface 120 defined in one of two sides thereof and the guide surface 120 extends in the direction inclined relative to the slots 24. A shoulder portion 14 is connected between the plate 12 and the recess 13. The two first fixed jaw member 200 and the second fixedly jaw member 11 are combined to be a fixed jaw relative to the movably jaw 30 which will be described hereinafter.

A handle 50 has a curved action end 51 pivotally connected between the first part 20 and the third part 21 by a pin member 53 and two plastic plates 54 attached to the other end of the handle 50.

A movable jaw 30 is movably received between the first part 20 and the third part 21. A first spring 35 has one end thereof connected to the movable jaw 30 and the other end of the first spring 35 securely received in the recess 13 of the second part 10. The movable jaw 30 has two serrated protrusions 34 extending laterally from two opposite faces thereof and the protrusions 34 are respectively and movably received in the two slots 24 of the first part 20 and the third part 21 so that when the movable jaw 30 is moved relative to the second fixed jaw member 11, the two protrusions 34 are moved within the two slots 24. It is to be noted that the first spring 35 normally pulls the movable jaw 30 toward the second fixed jaw member 11 as shown in FIG. 3. A toothed portion 33 is defined in an end of the movable jaw 30.

A pawl member 40 is movably installed between the movable jaw 30 and the plate 12 of the second part 10. The pawl member 40 has the first end 42 thereof contacting the action end 51 of the handle 50 between the first part 20 and the third part 21. A second spring 44 is connected between the second end of the pawl member 40 and the shoulder portion 14 of the second part 10, wherein the second spring 44 normally pushes the pawl member 40 away from the second fixed jaw member 11 as shown in FIG. 3. The pawl member 40 has a first side 41 slidable on the guide surface 120 of the plate 12 and a second side 43 having a toothed surface which is disengagably engaged with the toothed portion 33 of the movable jaw 30.

Figure 4:
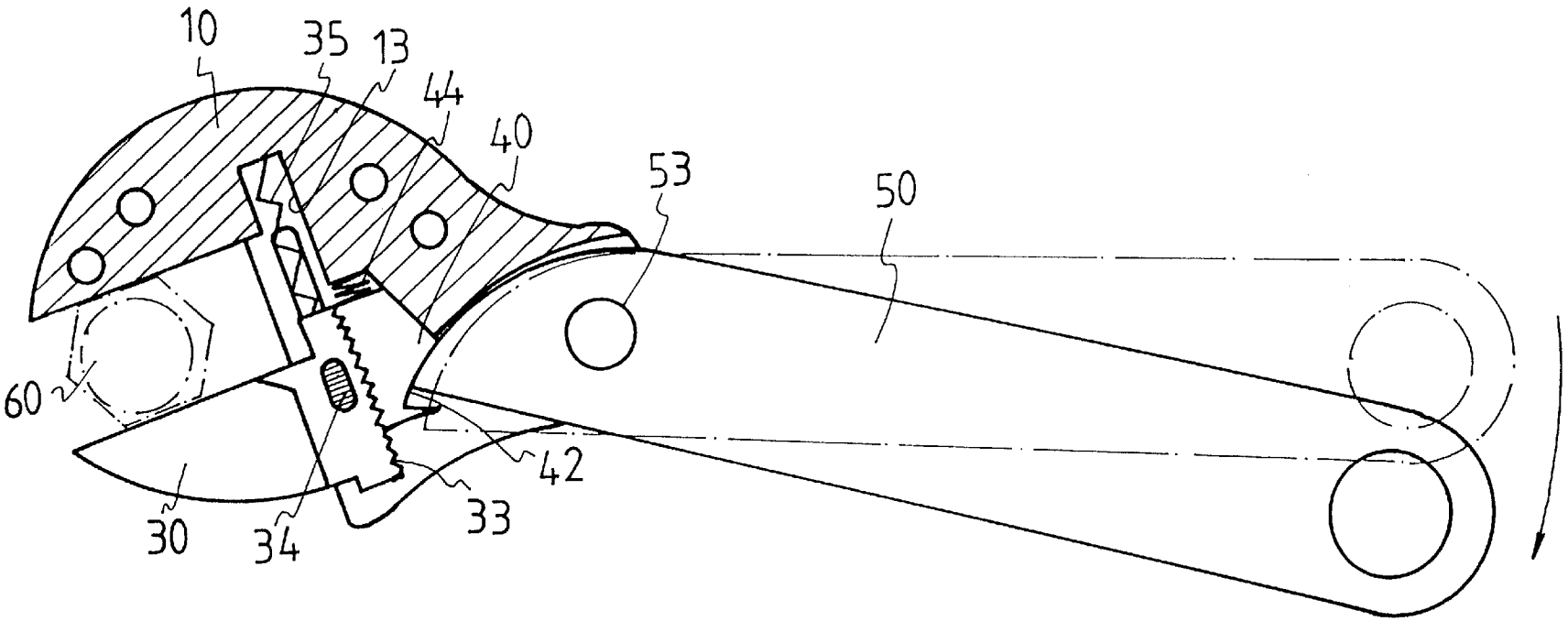
FIG. 4 is a side elevational view, partly in section, of the pliers when an object is clamped between the two jaws thereof.

Referring to FIG. 4, when pulling one of the protrusions 34 away from the first spring 35, an object 60 can be clamped between the movable jaw 30 and the fixed jaw. When rotating the handle 50 in the tightening direction, the pawl member 40 is pushed along the guide surface 120 and compresses the second spring 44 so that the second side 43 with the toothed surface of the pawl member 40 is engaged with the toothed portion 33 of the movable jaw 30 so as to rotate the object 60.

Figure 5:
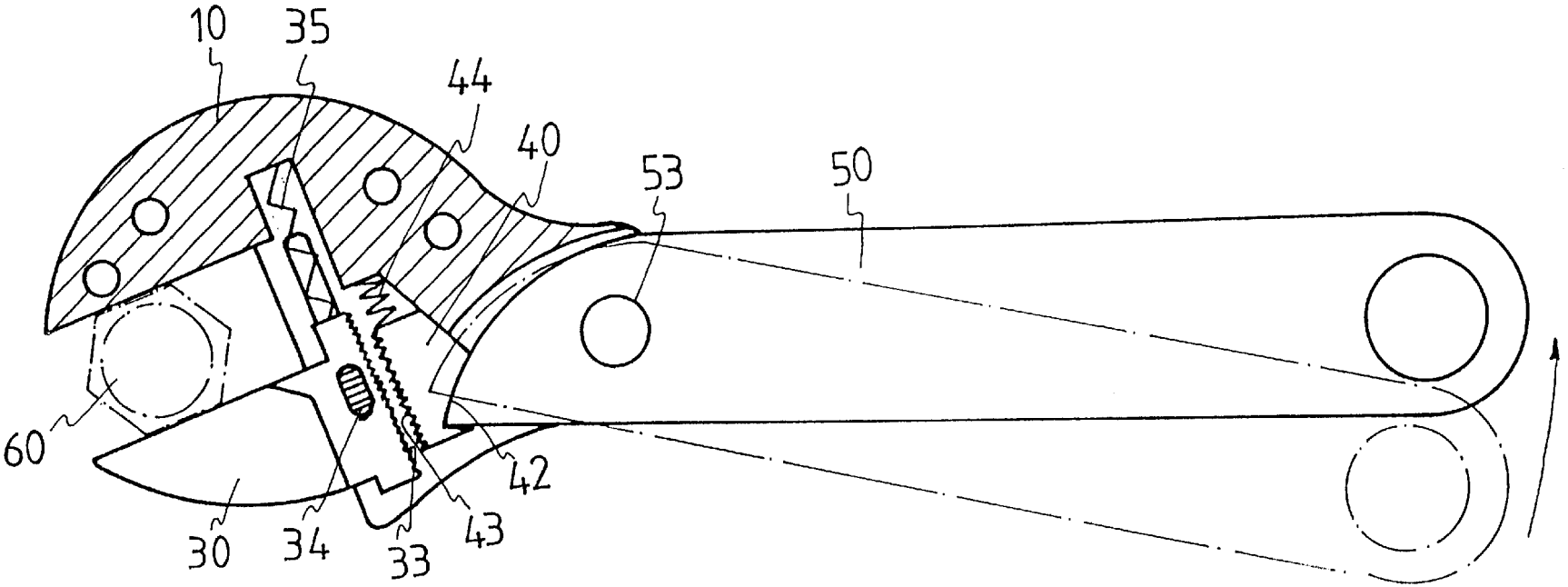
FIG. 5 is a side elevational view, partly in section, of the pliers when the handle of the pliers is rotated in the loosening direction, the movable jaw is disengaged from the object.

Referring to FIG. 5, when rotating the handle 50 in the loosening direction, the pawl member 40 is not pushed by the handle 50 and the second spring 44 pushes the pawl member 40 along the guide surface 120 to disengage the second side 43 with the toothed surface of the pawl member 40 from the toothed portion 33 of the movable jaw 30 so as to release the object 60. Therefore, the handle 50 can be reciprocatingly operated without removing the pliers from the object 60.

The invention is not limited to the above embodiment but various modification thereof may be made. It will be understood by those skilled in the art that various changes in form and detail may made without departing from the scope and spirit of the present invention.

What is claimed is:

1. A pair of pliers comprising:

a head comprising a first part, a second part and a third part, said second part fixedly connected between said first part and said third part, each of said first part and said third part having a slot defined therethrough and a first fixed jaw member extending laterally therefrom, said second part having a second fixed jaw member sandwiched between said two first fixed jaw members, a recess defined in said second fixed jaw member and a plate extending inclinedly from said second fixed jaw member, said plate having a guide surface defined in one of two sides thereof, a shoulder portion connected between said plate and said recess;

a handle having an action end pivotally connected between said first part and said third part;

a movable jaw movably received between said first part and said third part, a first spring having one end thereof connected to said movable jaw and the other end of said first spring securely received in said recess of said second part, said movable jaw having two protrusions extending laterally from two opposite faces thereof and respectively and movably received in said two slots of said first part and said third part, a toothed portion defined in an end of said movable jaw, and a pawl member movably installed between said movable jaw and said plate of said second part, said pawl member having the first end thereof contacting said action end of said handle between said first part and said third part, a second spring connected between the second end of said pawl member and said shoulder portion of said second part, said pawl member having a first side slidable on said guide surface of said plate and a second side having a toothed surface which is disengagably engaged with said toothed portion of said movable jaw.

2. The pair of pliers as claimed in claim 1, wherein said first spring pulls said movable jaw toward said second fixed jaw member.

3. The pair of pliers as claimed in claim 1, wherein said second spring pushes said pawl member away from said second fixed jaw member.

4. The pair of pliers as claimed in claim 1, wherein said action end is a curved end which pushes said pawl member along said guide surface when rotating said handle.

5. The pair of pliers as claimed in claim 1, wherein said guide surface is inclined relative to said slots.

* * * * *